US008479446B2

(12) United States Patent
Schaff

(10) Patent No.: US 8,479,446 B2
(45) Date of Patent: Jul. 9, 2013

(54) DRIVE SYSTEM FOR A DOOR

(75) Inventor: Gerd Schaff, Kirchheim/Teck (DE)

(73) Assignee: Sommer Antriebs-und Funktechnik GmbH, Kirchheim/Teck (DE)

( * ) Notice: Subject to any disclaimer, the term of this patent is extended or adjusted under 35 U.S.C. 154(b) by 279 days.

(21) Appl. No.: 12/747,821

(22) PCT Filed: Nov. 28, 2008

(86) PCT No.: PCT/EP2008/010122

§ 371 (c)(1),
(2), (4) Date: Jun. 11, 2010

(87) PCT Pub. No.: WO2009/086866

PCT Pub. Date: Jul. 16, 2009

(65) Prior Publication Data

US 2010/0263288 A1 Oct. 21, 2010

(30) Foreign Application Priority Data

Jan. 11, 2008 (DE) ..... 10 2008 004 050

(51) Int. Cl.
*E05F 11/00* (2006.01)

(52) U.S. Cl.
USPC ..... 49/358; 49/139

(58) Field of Classification Search
USPC ..... 49/358, 139, 140, 197, 199
See application file for complete search history.

(56) References Cited

U.S. PATENT DOCUMENTS

| | | | | |
|---|---|---|---|---|
| 2,700,542 | A * | 1/1955 | Geyer | 254/359 |
| 2,747,863 | A * | 5/1956 | Huppert et al. | 318/489 |
| 2,755,081 | A * | 7/1956 | Johnson et al. | 160/188 |
| 4,625,456 | A * | 12/1986 | Lafontaine | 49/358 |
| 4,750,294 | A * | 6/1988 | Lafontaine | 49/28 |
| 4,754,572 | A * | 7/1988 | Bilt | 49/358 |
| 5,076,012 | A * | 12/1991 | Richmond et al. | 49/28 |
| 7,048,029 | B2 * | 5/2006 | Rieder et al. | 160/188 |
| 7,856,758 | B2 * | 12/2010 | Ressel et al. | 49/358 |
| 2003/0205338 | A1 * | 11/2003 | Mullet et al. | 160/188 |
| 2011/0232196 | A1 * | 9/2011 | Robinson | 49/199 |

FOREIGN PATENT DOCUMENTS

| | | |
|---|---|---|
| DE | 41 05 872 A1 | 8/1992 |
| DE | 198 08 696 A1 | 8/1999 |
| EP | 1 496 185 A | 1/2005 |

OTHER PUBLICATIONS

English translation of the Written Opinion of the International Searching Authority, issued in connection with International Patent Application No. PCT/EP2008/010122.
International Search Report From PCT/EP2008/010122 Dated March 2, 2009 With English Translation.

* cited by examiner

*Primary Examiner* — Jerry Redman
(74) *Attorney, Agent, or Firm* — Venable LLP; Robert Kinberg

(57) ABSTRACT

The invention relates to a drive system for a gate, the gate panel thereof being guided in a guide rail on each side. A carriage is guided in one of the guide rails, and a pusher arm is joined with a hinge to the carriage and the upper edge of the gate panel. A motor is supported on the pusher arm.

11 Claims, 6 Drawing Sheets

DRIVE SYSTEM FOR A DOOR

CROSS-REFERENCE TO RELATED APPLICATIONS

This application is a National Stage Application of PCT/EP2008/010122, filed Nov. 28, 2008, which designates the United States and claims the priority of German Patent Application DE 10 2008 004 050.9, filed on Jan. 11, 2008, the subject matter of which is incorporated herein by reference.

BACKGROUND

The invention relates to a drive system for a gate.

The gate driven by the drive system in particular is a louver-type gate, wherein this gate typically is a garage door.

The blades of the gate are guided inside guide rails, mounted on each side, which move along the gate frame and the ceiling of the garage. Known drive systems for gates of this type are provided with a motor traversing along one of the guide rails. The motor is positioned on a pedestal or the like which is positioned so as to move with the aid of rollers in the guide rail. A push rod is attached articulated to the pedestal and is also attached articulated to the top blade of the gate. The gate is opened or closed as a result of the motor traversing along the guide rails.

One problem with systems of this type is that these systems need to be adapted individually to the respective gate and the guide rails. This individual adaptation of the drive systems results in undesirably high production costs for the drive systems.

SUMMARY

It is the object of the present invention to make available a drive system for a gate which has a high functionality and can additionally be produced efficiently and cost-effectively.

This object is solved with the features disclosed in claim 1. Advantageous embodiments and useful modifications of the invention are described in the dependent claims.

The drive system according to the invention is used for opening and closing a gate provided with a gate panel which is guided on the side in respectively one guide rail. A carriage is guided in one of the guide rails and a push arm is attached articulated to the carriage and to the upper edge of the gate panel. A motor is positioned on the push arm.

Since the motor of the drive system according to the invention is attached to the push arm that provides the connection to the gate, the installation of the motor is uncoupled from the guide rail and therefore does not depend on the individual embodiment of the guide rail.

A carriage moves on the guide rail itself, wherein this carriage preferably is provided with rollers that move inside the guide rail. According to one particularly advantageous embodiment, this carriage forms the only application-specific part of the drive system. The adaptation to the specific embodiment of the guide rail is achieved with a corresponding design of the carriage.

The drive system according to the invention consequently has a modular design which can be adapted to different gate systems with little structural expenditure and can thus be produced efficiently and cost-effectively.

According to a particularly advantageous embodiment of the invention, the carriage comprises universally embodied means for connecting it to the push arm.

The connecting means provided on the carriage for connecting it to the connection means on the push arm are embodied for this as a plug-in rotating bearing.

The connecting means on the push arm can be inserted in one insertion direction into the means for connecting the carriage and these elements are then secured to each other by rotating the elements relative to each other.

An especially simple connection is thus created between the push arm and the carriage. The connection takes the form of a plug-in connection which can be realized without tools or the use of additional fastening means. The installation of the push arm on the carriage can therefore be realized quickly and without auxiliary means.

With the drive system according to the invention, different traction means which engage in the motor can thus be used, for example belts, bands, toothed belts.

It is particularly advantageous if the drive system according to the invention is embodied as a chain drive. In that case, a chain wheel is arranged on a shaft of the motor which, during the operation of the drive system, engages in a chain that is guided along the guide rail.

It is particularly advantageous if a chain duct in which the chain is guided and a conductor rail with therein disposed electrical lines for the power supply are secured on a sliding guide of the carriage.

The drive system is provided in this way with a particularly high modularity. The chain guide and the conductor rail, embodied particularly advantageously as one part, are attached independent of the guide rail to the sliding guide as application-specific element of the carriage. No structural interventions on the guide rail are therefore necessary for attaching the chain rail and the conductor rail.

The drive system according to the invention can thus be attached easily and without structural intervention on the existing gate system, on any one of the guide rails.

With this structural design, the motor can be supplied easily with power via a circuit board that is positioned in the carriage and can make electrical contact with the motor, wherein this circuit board comprises projecting contact pins which are in contact with the electrical lines of the conductor rail.

The circuit board itself and its connections to the motor can be installed as a universal component. This is advantageously also true for the contact pins on the circuit board if the conductor rail on the carriage is adapted in such a way that the contact pins can be used for differently embodied conductor rails.

It is particularly advantageous if the drive system according to the invention is provided with an emergency release that can be activated manually, so that the gate can still be opened manually even during a power failure.

For the embodiment of the emergency release, the motor rests especially advantageously on a motor mount which is positioned on the push arm with the aid of a swivel mount and a locking connection, wherein the locking connection can be unlocked to activate the emergency release. The motor is conditionally automatically pivoted in downward direction, thus disengaging the chain wheel from the chain, wherein the pivoting in this case can be triggered either by the forces of gravity or by spring forces.

This emergency release has a high functional safety with low structural expenditure.

BRIEF DESCRIPTION OF THE DRAWINGS

The invention is explained in further detail in the following with the aid of the drawings, which show in.

DETAILED DESCRIPTION

Figure 1:
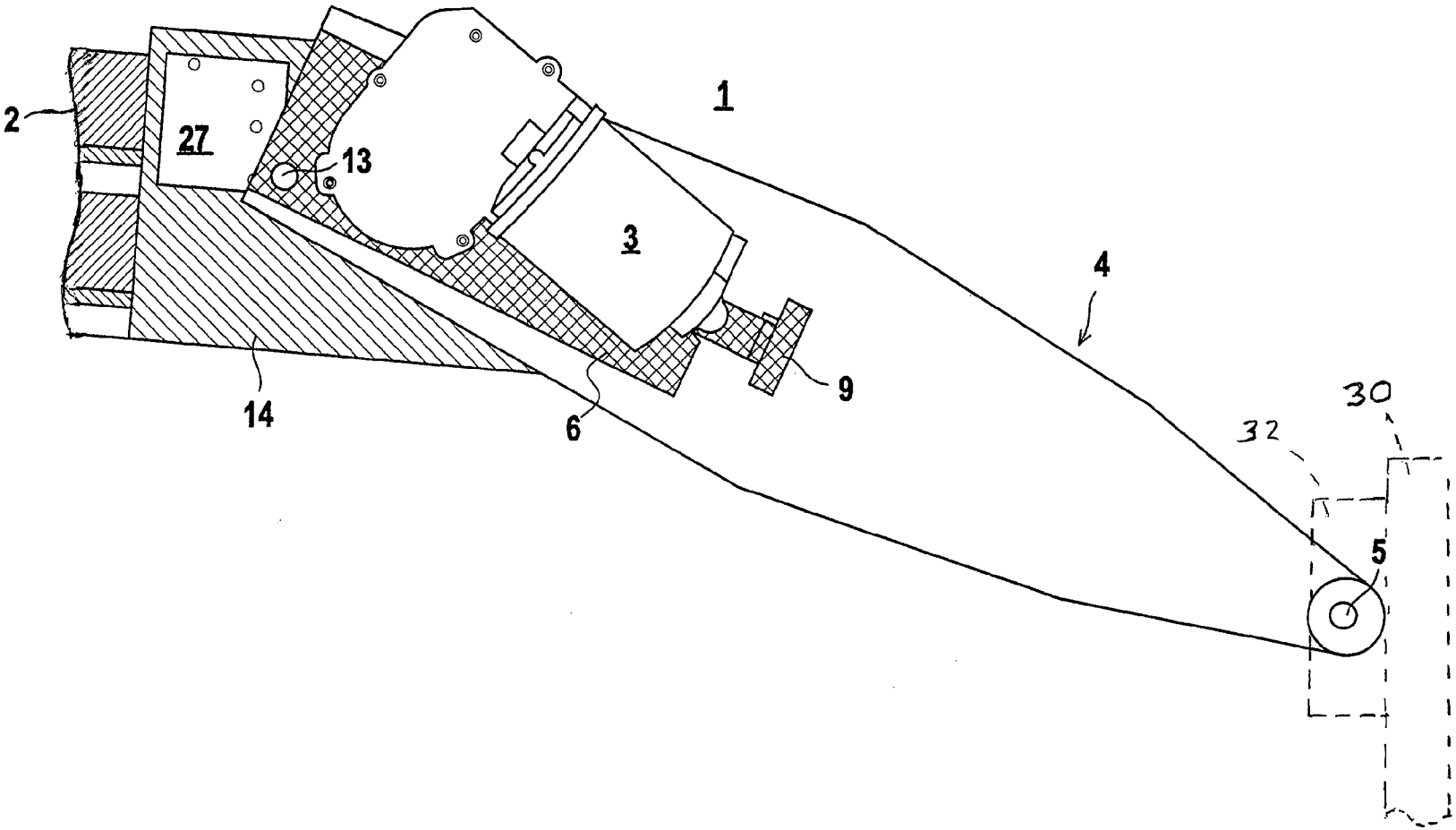
FIG. 1: A view from the side of an exemplary embodiment of the drive system according to the invention.
Figure 2:
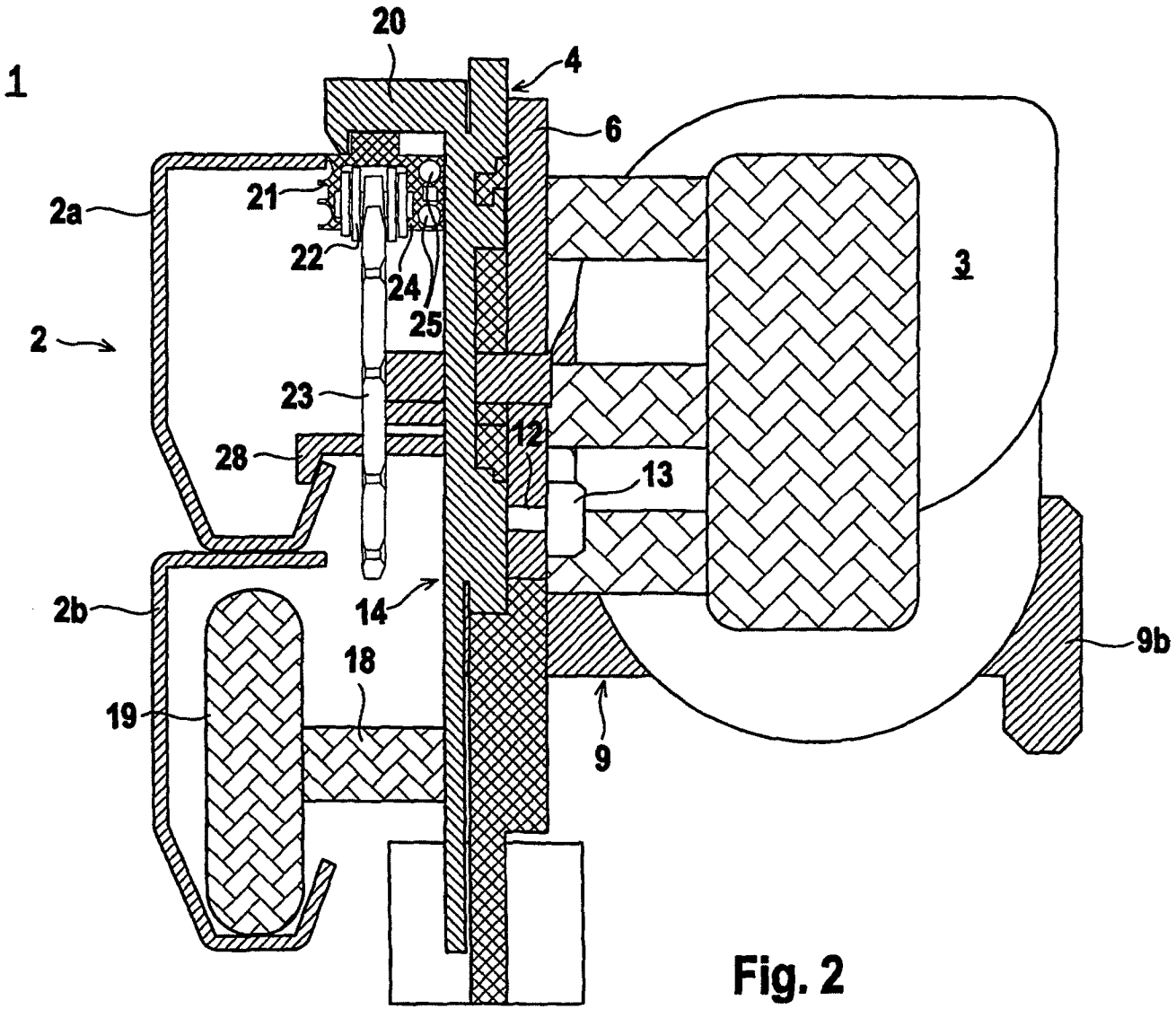
FIG. 2: A cross section through the drive system according to FIG. 1.

FIGS. 1 and 2 show an exemplary embodiment of a drive system 1 for a gate embodied as louvered gate which, for the present case, is embodied as a garage door. The blades (also referred to herein as panels) for the louvered gate are guided on the side in guide rails 2, wherein FIG. 1 partially shows one of the guide rails 2. As shown in FIG. 2, the identically embodied guide rails 2 have an upper rail element 2*a* and a lower rail element 2*b* which extend below the garage ceiling. The uppermost blades (panels) for the gate can be guided with the aid of rollers inside the upper rail element 2*a*, while the rollers of the following blades are guided inside the lower rail element 2*b*. The guide rails 2 furthermore also extend on the side of the gate opening that can be closed with the gate.

The drive system 1 can optionally be attached to one of the guide rails 2. The drive system 1 in this case is arranged so as to move along on one of the guide rails 2, wherein the gate is opened or closed as a result of the drive system 1 traversing back and forth.

Figure 3:
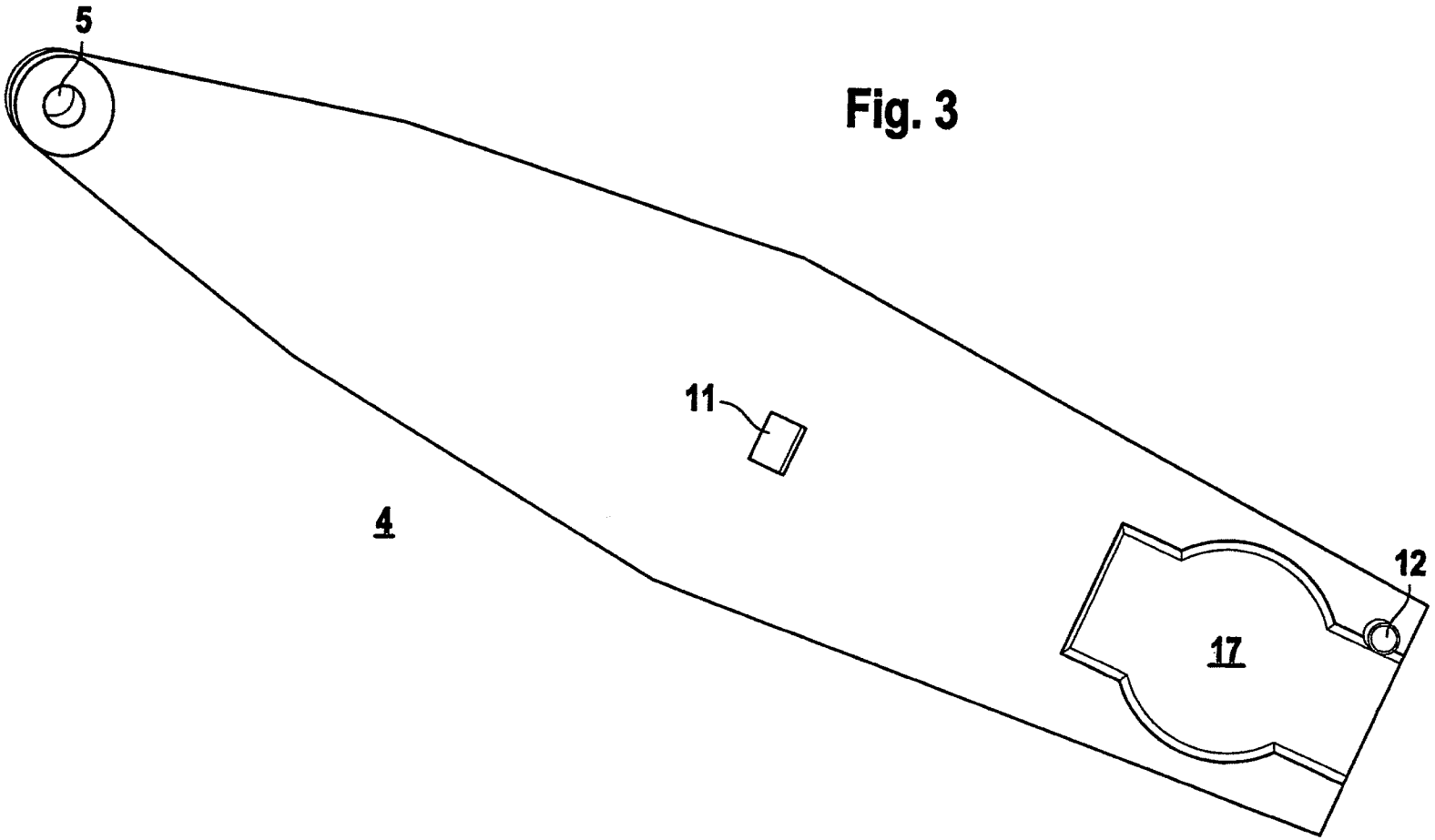
FIG. 3: An individual representation of a push arm functioning as a component of the drive system according to FIGS. 1 and 2.

The drive system 1 is provided with a motor 3 which is embodied as electric motor. The motor 3 is positioned on a push-arm 4 that forms the connection to the gate. The push-arm 4 is shown as individual representation in FIG. 3. The push-arm 4 is provided with a bore 5 in which the upper blade (panel) 30 of the gate (partially shown in FIG. 1) can be attached articulated with the aid of a fastening means 32 schematically shown in FIG. 1.

In the simplest case, the motor 3 can be mounted directly on the push arm 4. For the present case, the motor 3 is attached to a motor mount 6, wherein the motor mount 6 in turn is attached to the push arm 4. The motor mount 6 forms a component of an emergency release and is shown in a separate representation in FIG. 4.

Figure 4:
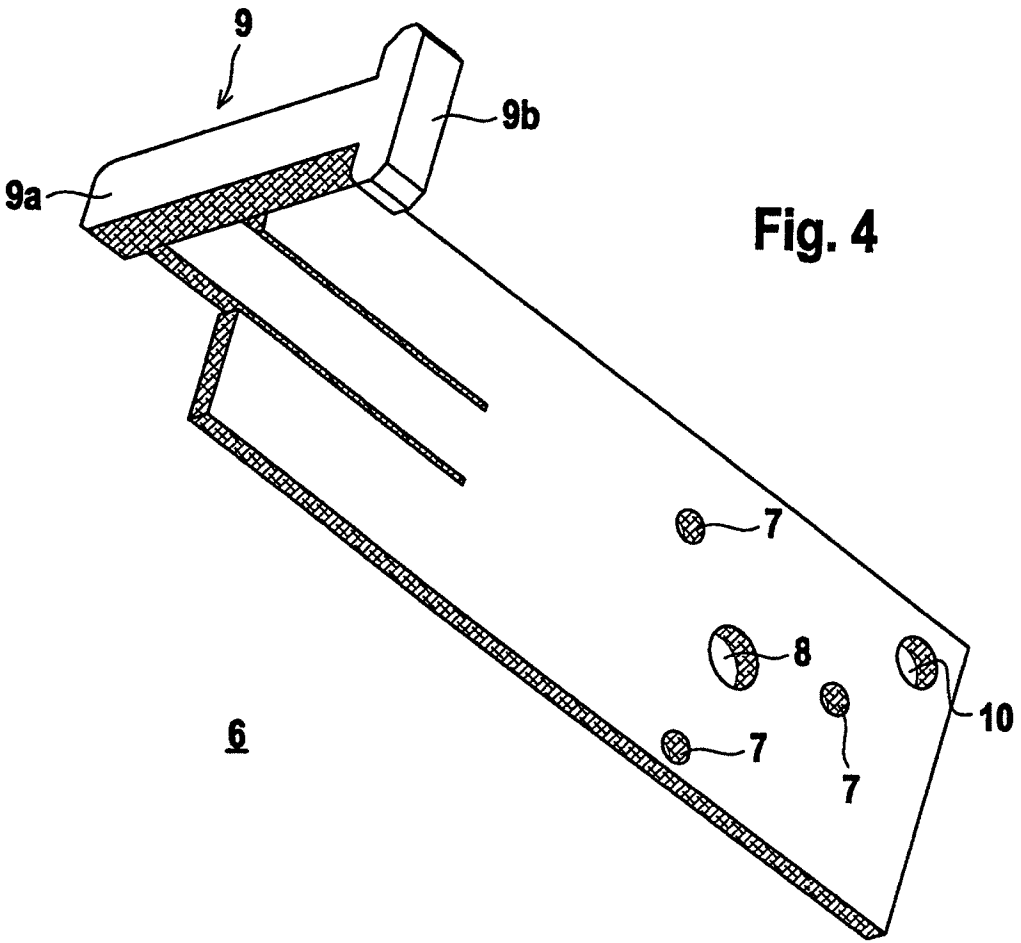
FIG. 4: An individual representation of a motor mount as a component of the drive system according to FIGS. 1 and 2.

As can be seen in FIG. 4, the motor mount 6 comprises three locating bores 7 into which screws, not shown herein, are inserted to securely screw the motor 3 to the motor mount 6. In the center of the locating bores 7 is a through bore 8 through which the shaft of the motor 3 extends once the motor is secured on the motor mount 6.

The motor mount 6 is provided with a locking pin 9 and a bore 10 for securing it on the push arm 4. The locking pin 9 is provided with a locking element 9*a* which projects over the underside of the motor mount 6 and can be made to engage in an opening 11 in the push arm 4. The portion of the locking pin 9 that projects over the top of the motor mount 6 forms a grip 9*b* which can be used to manually release the locking element 9*a* from the opening 11.

The bore 10 can be fitted over a bolt 12 that projects from the push arm 4. FIG. 2 shows that inserting the bolt 12 into the bore 10 results in providing a bolt head 13 which projects over the end of the bolt 12 from the bore 10, thus providing a safety feature to prevent the motor mount 6 from disengaging from the push arm 4. With these fastening means, the motor mount 6 is securely attached to the push arm 4.

Figure 5:
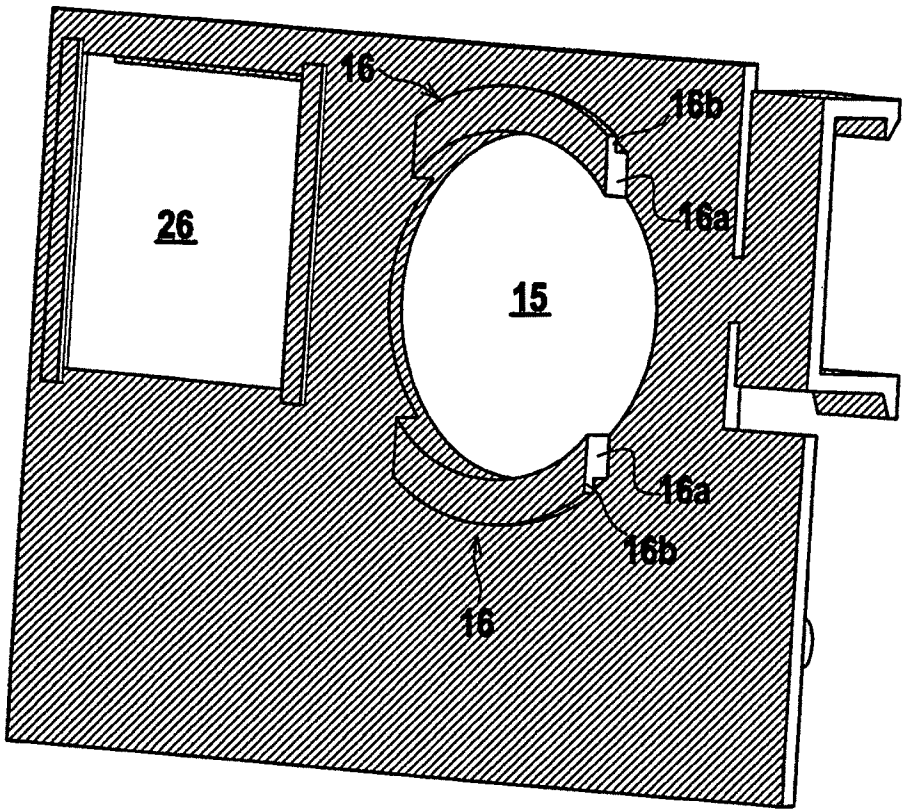
FIG. 5: A view from above of the side facing the push arm of a carriage, as component of the drive system according to FIGS. 1 and 2.
Figure 6:
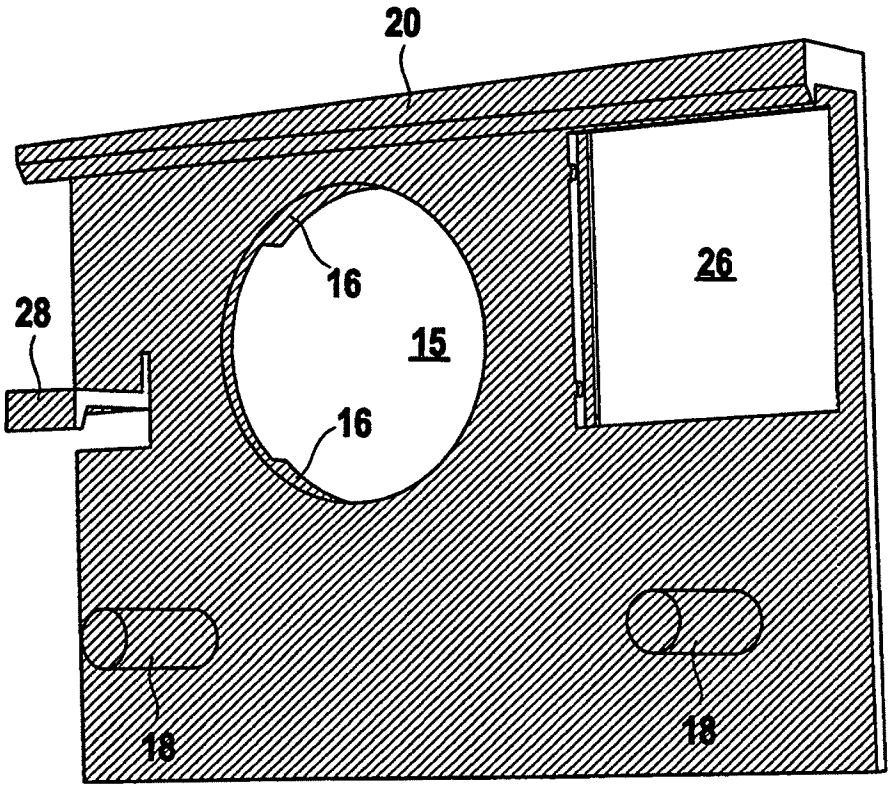
FIG. 6: A view from above of the facing away from the push arm, as component of the drive system according to FIGS. 1 and 2.

The push arm 4 is attached articulated to a carriage 14 which is positioned such that it can traverse along the guide rail 2. FIG. 5 shows the side of the carriage 14 that faces the push arm 4. FIG. 6 shows the side of the carriage 14 which faces away from the push arm 4.

The carriage 14 is embodied plate-shaped and is provided with a circular opening 15. At opposite-arranged edge segments which delimit the opening 15, two identically embodied guide elements 16 are provided as means for connecting to the push arm 4, wherein these guide elements project from the carriage 14 side which is facing the push arm 4. The guide elements 16 extend along the edge segments and are embodied as beam-shaped elements 16*a* provided with respectively one projection 16*b* which extends outward from the side facing away from the opening 15.

The push arm 4 is provided with a recess 17 that stops at a longitudinal side end and functions as a means for connecting to the guide elements 16 of the carriage 14. The recess 17 is delimited on the front end, meaning in the region where it ends, as well as at the back end by two straight-line and parallel extending edge segments of the push arm 4. The center section of the recess 17 is delimited by two edge segments extending along a circular arc.

The widths for the back and the front sections of the recess 17 slightly exceed the distances between the longitudinal side edges of the guide elements 16. The diameter for the center section of the recess 17 is slightly larger than the diameter of the circle along which the outer surfaces extend of the beam-shaped elements 16*a* of the guide elements 16. The height of the beam-shaped elements 16*a* slightly exceeds the thickness of the push arm 4 in the region of the recess 17.

In order to attach the push arm 4 to the carriage 14, the recess 17 of the push arm 4 is moved in one insertion direction, while resting on the carriage 14, so that the guide elements 16 are inserted into the recess 17. The push arm 4 is then turned, so that the projections 16*b* engage behind the edge segments of the push arm 4 which delimit the circular-arc shaped portion of the recess 17. As a result, the push arm 4 is secured against being disconnected from the carriage 14. The guide elements 16, which are positioned rotating along the edges of the recess 17, form an articulated connection between the push arm 4 and the carriage 14.

The rotating bearing between the push arm 4 and the carriage 14 forms a universal coupling for the two parts. The carriage 14 is otherwise the only application-specific part of the drive system 1. For the connection to different gate systems, in particular guide rails 2, only the carriage 14 must consequently be replaced when using the drive systems 1 according to the invention.

FIG. 6 shows the side facing the guide rail 2 of the carriage 14 with the application-specific components. Projecting from the carriage 14 are two holders 18 with thereto attached rollers 19 which are guided inside the guide rail 2, as shown in FIG. 2, thereby allowing the carriage 14 to traverse along the guide rail 2.

A rail-type sliding guide 20 extends along the top of the carriage 14. Attached to this sliding guide 20, which is positioned to the side of the guide rail 2, is a chain duct 21 with therein disposed chain 22 that extends along the guide rail 2. During the operation of the drive system 1, the chain 22 engages in a chain wheel 23 which is fitted onto the exposed end of the motor 3 shaft. The motor 3 drives the chain wheel 23, causing it to move in the chain 22 and thus move the drive system 1 along the guide rail 2 which results in the opening and closing of the gate.

The motor 3 is supplied with power via a conductor rail 24 with therein positioned electrical lines 25. The conductor rail 24 is embodied as one piece with the chain duct 21.

The carriage 14 has a rectangular opening 26 (FIG. 6) with therein mounted circuit board 27 that is provided with electronic components for controlling the motor 3 (FIG. 1). The circuit board 27 is provided with contact pins, not shown herein, for establishing electrical contact with the lines 25 in the conductor rail 24, thereby ensuring the power supply for the motor 3.

A holding element 28 that forms mounting pins for installing the drive system 1 on the guide rail 2 projects from the side of the carriage 14 that is facing the guide rail 2. With the aid of the holding element 28, the carriage 14 can be hooked into the upper rail element 2*a* of the guide rail 2. Additional installation steps can be carried out in this position, in particular the installation of the chain wheel 23 on the shaft. Following the installation, the carriage 14 is in the desired position shown in FIG. 2 in which the holding element 28 is again lifted off the upper rail element 2*a*.

The motor mount 6 which is positioned on the push arm 4 forms the central element for the emergency release of the drive system 1, for example carried out manually by an operator during a power failure. For this, the locking element 9*a* is released from the opening 11 of the push arm 4 by activating the grip 9*b* of the locking pin 9, wherein a rope or the like can be attached to the grip 9*b* to permit a manual unlocking of the garage from the outside. As soon as the locking element 9*a* is released from the opening 11, the motor mount 6 is attached only with the bolt 12 of the push arm 4 which forms a rotating bearing. As a result of gravity, the motor 3 then drops downward and the motor mount 6 is pivoted, relative to the pivot mount, meaning with respect to the bolt 12. The chain wheel 23 is thus moved downward and consequently disengages from the chain 22, meaning the emergency release of the drive system 1 is completed.

The invention claimed is:

1. A drive system for a gate having a gate panel that is guided on a side of the gate panel along a guide rail, the drive system comprising:

a carriage guided along the guide rail;

a push-arm having opposite ends and being articulated, adjacent one of the opposite ends, to the carriage and articulated, adjacent the other of the opposite ends, to the gate panel;

a motor positioned on the push-arm, the motor including a shaft and a chain wheel mounted on the shaft;

a fraction mechanism comprising a chain extending along the guide rail and engaging the chain wheel, the chain wheel being driven by the motor to thereby move the carriage along the chain to open or close the gate; and a manually operable emergency release comprising a motor mount to which the motor is secured, the motor mount being connected to the push-arm by a rotating bearing and a locking element releasably engaged in an opening in the push-arm, wherein when the locking element is released from the opening the motor together with the motor mount is pivoted downwardly about the rotating bearing to thereby disengage the chain wheel from the chain.

2. The drive system according to claim 1, wherein the carriage is configured to be optionally attached to the guide rail.

3. The drive system according to claim 1, wherein the carriage is specific in respect to different guide rails.

4. The drive system according to claim 3, wherein the carriage is provided with a universal coupling for articulating the carriage to the push-arm.

5. The drive system according to claim 4, wherein the universal coupling provided on the carriage is configured to be connected to a connector on the push-arm, the universal coupling provided on the carriage comprising a plug-in rotating bearing.

6. The drive system according to claim 5, wherein the connector for the push-arm can be inserted in one insertion direction into the universal coupling for the carriage and that the connector and the universal coupling are secured to each other with the aid of a relative rotation of the universal coupling and the connector.

7. The drive system according to claim 1, wherein the carriage comprises a roller or sliding guide configured to guide the carriage along the guide rail.

8. The drive system according to claim 1, wherein the carriage includes a slide guide in the form of a rail to which a chain duct is attached.

9. The drive system according to claim 8, wherein a conductor rail extends along the chain duct, wherein the conductor rail comprises electrical lines for supplying power to the motor.

10. The drive system according to claim 9, wherein at least a portion of the conductor rail is embodied integrally with the chain duct.

11. The drive system according to claim 9, wherein a circuit board, which can electrically contact the motor, is positioned in the carriage, wherein contact pins project from the circuit board for contacting the electrical lines of the conductor rail.

* * * * *

UNITED STATES PATENT AND TRADEMARK OFFICE

CERTIFICATE OF CORRECTION

PATENT NO. : 8,479,446 B2
APPLICATION NO. : 12/747821
DATED : July 9, 2013
INVENTOR(S) : Gerd Schaaf It is certified that error appears in the above-identified patent and that said Letters Patent is hereby corrected as shown below:

Title Page (75) Inventor should read: Gerd ~~Schaff~~ Schaaf, Kirchheim/Teck (DE)

Signed and Sealed this
Fifteenth Day of October, 2013

Teresa Stanek Rea
*Deputy Director of the United States Patent and Trademark Office*